United States Patent [19]

Stahl

[11] 4,093,070

[45] June 6, 1978

[54] STACKING AND NESTING CONTAINER

[75] Inventor: Edward L. Stahl, Richmond, Mich.

[73] Assignee: Pinckney Molded Plastics, Inc., Pinckney, Mich.

[21] Appl. No.: 775,727

[22] Filed: Mar. 9, 1977

[51] Int. Cl.[2] ..... B65D 21/04

[52] U.S. Cl. ..... 206/507; 206/518

[58] Field of Search ..... 206/505, 506, 507, 518, 206/515, 519, 520

[56] References Cited

U.S. PATENT DOCUMENTS

| | | | |
|---|---|---|---|
| 3,392,875 | 7/1968 | Bockenstette | 206/507 |
| 3,622,031 | 11/1971 | Wells | 206/507 |
| 3,773,213 | 11/1973 | Frederick | 206/507 |
| 3,780,905 | 12/1973 | Herulzer | 206/507 |
| 3,825,114 | 7/1974 | Johnson | 206/507 |

*Primary Examiner*—George E. Lowrance

[57] ABSTRACT

The container disclosed herein is adapted to stack or nest with a similarly oriented lower container of identical construction. The container side walls have stacking supports on their upper edges. Rests in the underside directly beneath these supports permit the container to be stacked at an upper level on a similarly or reversely oriented container of identical construction. The container end walls have second rests disposed above the level of the first mentioned rests and spaced apart the same distance as the stacking supports so that the container can be nested at a lower level with a 90° turned lower container of identical construction.

12 Claims, 17 Drawing Figures

STACKING AND NESTING CONTAINER

SUMMARY OF THE INVENTION

The container of this invention is adapted to either nest or stack with another container of identical construction.

In accordance with the specific embodiment disclosed, the container is square on the outside and nearly square inside. It has side and end walls. The upper edge portions of the side walls have elongated parallel stacking rails. Elongated parallel grooves are provided on the underside of the container directly under these rails so that the container can be slid to a stacked position at an upper level on another similarly or reversely oriented container of identical construction. The upper edge portions of the end walls of the container have elongated parallel grooves disposed above the level of the first grooves and spaced apart the same distance as the stacking rails so that the container can be nested at a lower level with a 90° turned lower container of identical construction. The side walls are spaced apart slightly farther than the end walls to permit the end walls to fit within the side walls of a lower container during nesting. The end walls are of less height than the side walls to clear the bottom of the upper nested container.

Other objects and features of the invention will become more apparent as this description proceeds, especially when taken in conjunction with the accompanying drawings, wherein.

Figure 1:
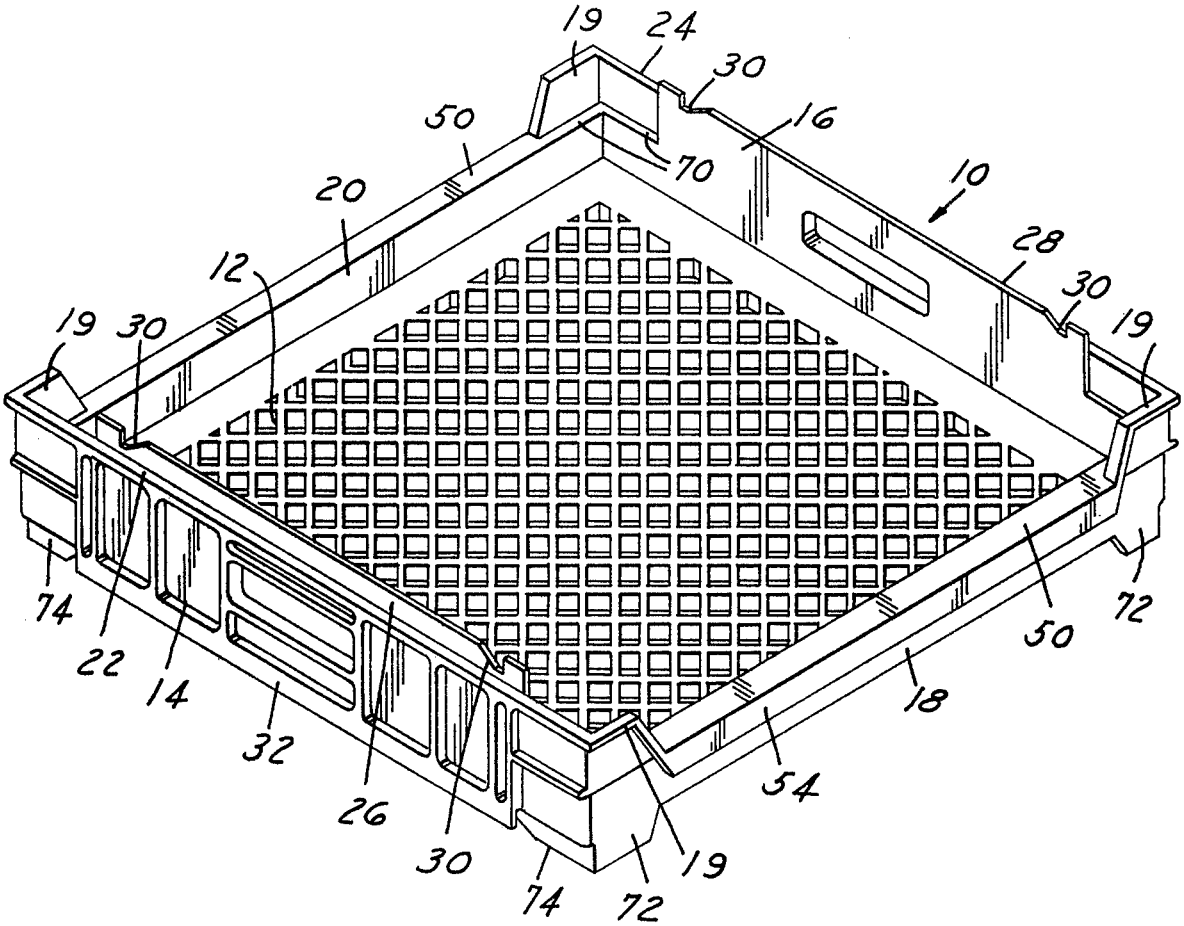
FIG. 1 is a perspective view of a container constructed in accordance with the invention.

Referring now more particularly to the drawings, the container is square in its outside dimensions and is designated by the numeral 10. All of the containers shown in the several views are of identical construction. They may be formed of any suitable material, preferably plastic, such for example as molded polyethylene or polypropylene. They may be used for any purpose but are in this instance designed primarily as bakery containers for bread, cakes, rolls and the like.

The container 10 has a rectangular horizontal bottom wall 12 which is nearly square but slightly wider than it is long, that is, it has a slightly greater dimension between its side walls 14 and 16 than between its end walls 18 and 20. The major portion of the surface area of the bottom wall is shown as being of an open crossing grid construction which is not necessary insofar as the invention is concerned but which has the advantage of lightening the structure and also making it easier to clean and hence maintain in a sanitary condition.

The side walls 14 and 16 of the container are parallel and extend substantially vertically upwardly from the opposite side edges of the bottom wall. The end walls 18 and 20 are also parallel and extend substantially vertically upwardly from the front and rear edges of the bottom wall. The end portions 19 of the end walls 18 and 20 are the same height as the side walls. However, between the end portions, the end walls are throughout the major portion of their length reduced to about half the height of the side walls as measured from the top surface of the bottom wall. The side walls are mirror images of one another as are the end walls.

The upper edges of the side walls 14 and 16 are defined by horizontal flanges or ledges 22 and 24. Horizontal stacking supports in the form of rails or ridges 26 and 28 project upwardly from the inner edge portions of the ledges 22 and 24. These rails are parallel and extend for a major portion of the full length of the side walls but terminate short of the front and rear of the container. The rails also have notches or interruptions 30, a pair of which are provided in each rail in spaced apart relation near the ends of the rail for a purpose which will become more apparent hereinafter.

The underside of the bottom wall 12 of the container is formed along each side edge with a stacking rest in the form of a pair of laterally spaced vertically downwardly extending ribs 32 and 34. Each pair of ribs defines a downwardly opening groove 36. These ribs 32,34 and grooves 36 are located at the junction of the bottom and side walls of the container and may be said to be formed on the side edges of the bottom wall or on the lower edges of the side walls. The grooves 36 on opposite sides of the container are parallel. They are directly beneath and spaced apart the same distance as the stacking rails 26 and 28. Transverse webs 38 close the opposite ends of the grooves. The webs 38 are spaced apart a distance equal to or slightly greater than the length of the rails 26 and 28. Inclined opposed pairs of webs 40 at spaced points along the length of the grooves are provided to confine the rail of a stacked container engaged therein to prevent lateral play. Webs 42 extend across each groove near the ends thereof and are spaced apart the same distance as and adapted to engage in the notches 30 of the stacking rail of a stacked container.

The upper edge portions of the end walls 18 and 20 are formed along their midportions of reduced height with laterally outwardly extending flanges 50 which terminate in downwardly extending flanges 54 to define downwardly opening parallel grooves 58. Grooves 58 are at a higher level than grooves 36. The grooves 58 on opposite ends of the container provide nesting rests and are spaced apart the same distance as the stacking rails 26 and 28. These grooves may if desired be closed at the opposite ends by transverse walls like the transverse walls 38 and 40 which close the ends of grooves 36 but in this specific embodiment no such walls are provided. Inclined webs 66 are provided at spaced points along the length of the grooves to confine the rail of a nested container engaged therein to prevent lateral play. Webs 68 extend across each of the grooves 58 intermediate its ends and are spaced apart the same distance as and adapted to engage in the notches 30 in the stacking rail of a nested container.

Referring to FIG. 1, it will be noted that the inside walls of the container at the four corners are set out slightly to form ledges 70 providing additional clearance with a nested container. The bottom of the nested container fits down to near the level of the ledges 70. The ledges 70 on the front and rear walls are provided because the side walls are spaced slightly farther apart than the front and rear walls. This added clearance on the front and rear walls facilitates nesting with a 90° turned upper container. The clearance 70 on the side walls could be eliminated without any adverse effect on nesting because the front and rear walls which fit inside the side walls of a lower container during nesting are spaced closer together than the side walls.

The bottom of the container at the four corners is provided with depending feet 72. These feet are recessed on the side of the container at the bottom where indicated at 74. The feet project beneath the ledges 70 in nesting so that the additional clearance provided by the recesses 74 is desirable.

The container is adapted to stack upon a second container of identical construction when it is similarly oriented or turned 180°, that is end for end, with respect thereto. When similarly oriented, the upper container is held at a level above the lower container and the rear ends of the grooves 36 are engaged with the forward portions of the stacking rails 26 and 28. The upper container may be held at a slight angle at this time with its front end elevated with respect to its rear end. The upper container may then be slid rearwardly across the lower container, gradually lowering the upper container during such movement into a horizontal position. Actually, the grooves will not fully engage the rails but rather the transverse webs 38 which close the ends of the grooves slide on the rails until the upper container is disposed directly over the lower container. When the upper container is directly over the lower container it will drop, causing the rails 26 and 28 to extend fully up into the grooves 36. At this time, the webs 38 will extend down over the ends of the rails and the webs 42 will extend into the notches 30 to locate the upper container. Such webs retain the upper container against forward and rearward movement from the fully stacked position. The inclined webs 40 in the grooves confine the rail of the lower container to prevent lateral play. In this stacked position, the groove bottoms may rest on the upper edges of the rails, or the outer ribs 32 of the grooves may rest upon the ledges 22 and 24 of the lower container.

The container when reversed end for end with respect to a lower container will stack in the same manner.

The container is adapted to nest with a second container of identical construction when it is turned 90° with respect thereto in either direction. The upper container may be held above the lower container in crossing relation and lowered directly into nested position. In the nested position, the grooves 58 along the end walls of the upper container receive the rails 26 and 28 along the side walls of the lower container. The webs 68 in the grooves of the upper container extend into the notches 30 of the stacking rails and the inclined webs 66 engage the sides of the rails, to prevent relative lateral movement of the containers. Actually the containers are held against relative lateral movement by the corner portions of the containers directly above the ledges 70. These ledges 70 of the lower container are spaced slightly below the bottom of the nested container to provide clearance. These ledges could if elevated slightly serve as a supplemental seating means for a nested container.

Figure 17:
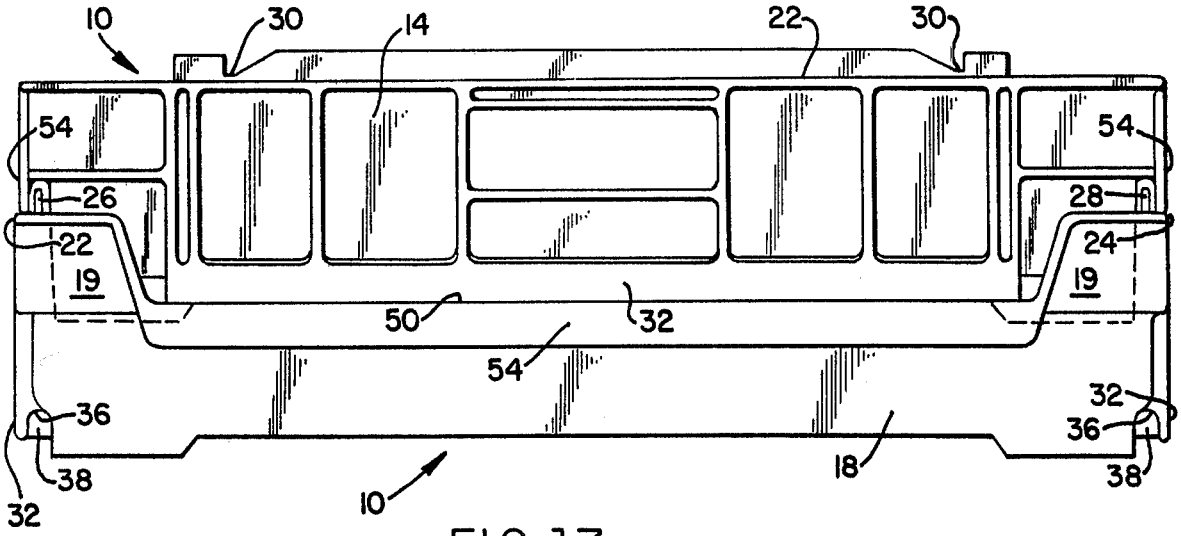
FIG. 17 is a view similar to FIG. 14 but shows a modification.
Figure 2:
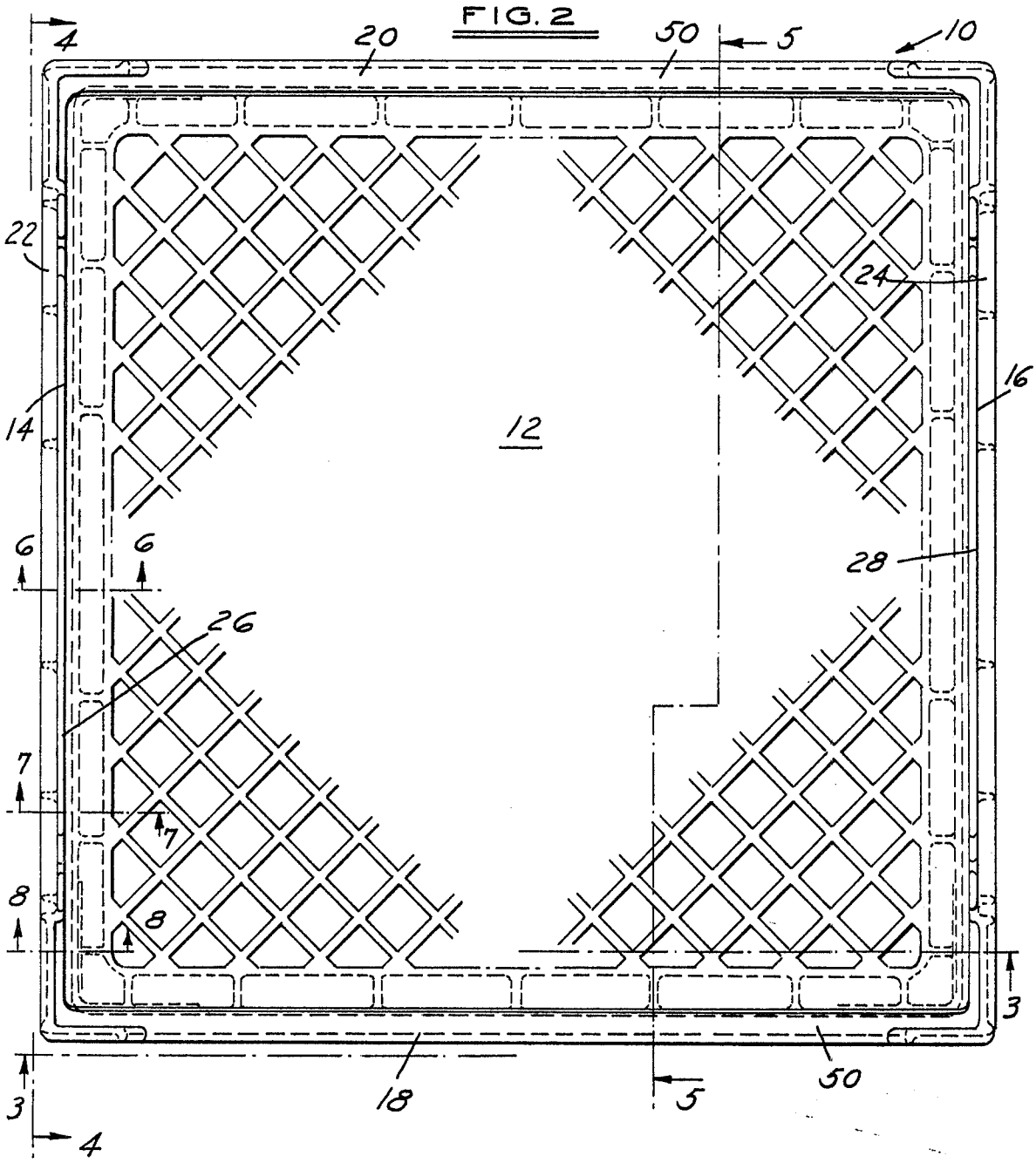
FIG. 2 is a top plan view of the container shown in FIG. 1.
Figure 3:
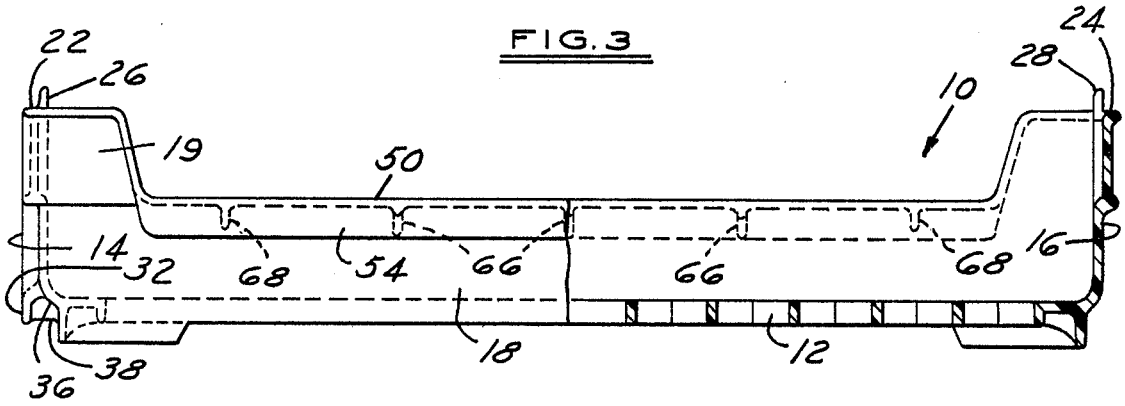
FIG. 3 is a front view partially in elevation and partially in section taken on the line 3—3 in FIG. 2.
Figure 6:
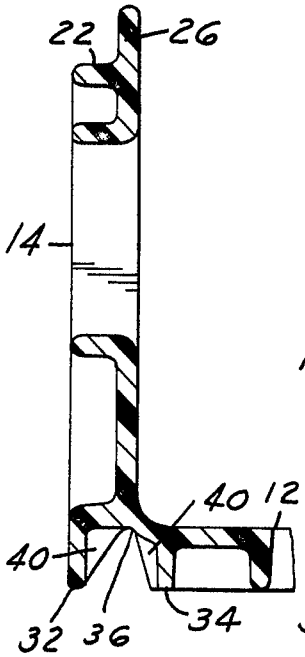
FIG. 6 is a fragmentary sectional view taken on the line 6—6 in FIG. 2.
Figure 7:
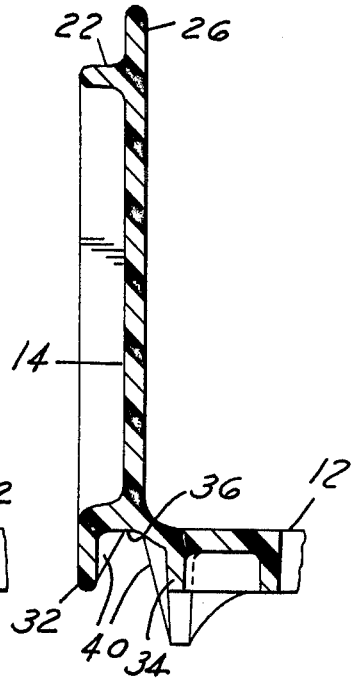
FIG. 7 is a fragmentary sectional view taken on the line 7—7 in FIG. 2.
Figure 8:
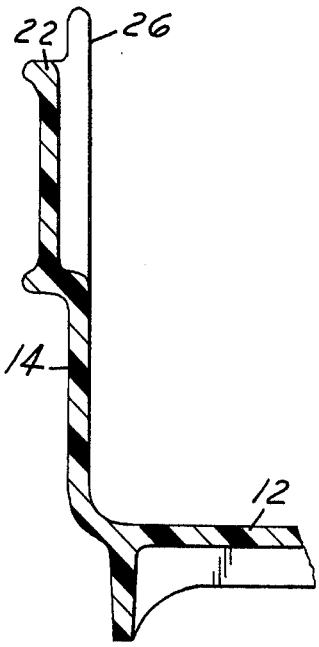
FIG. 8 is a sectional view taken on the line 8—8 in FIG. 2.
Figure 4:
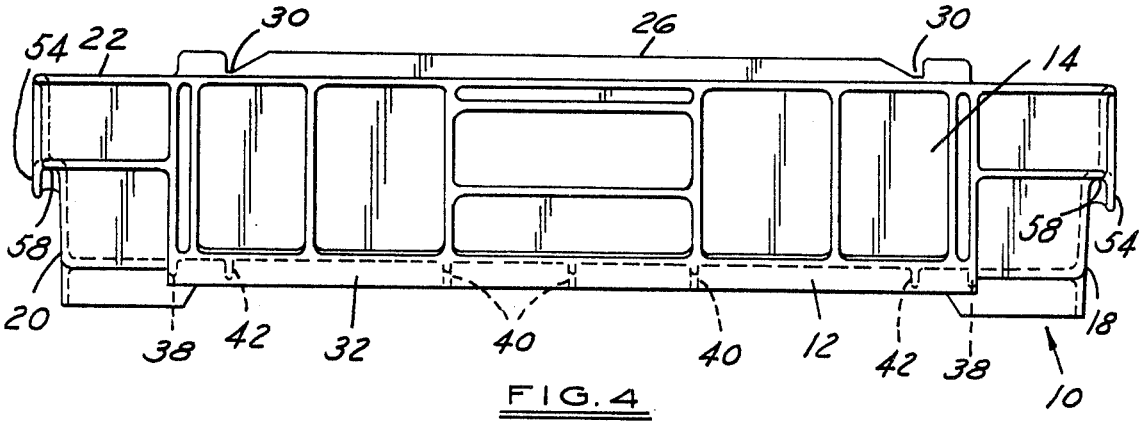
FIG. 4 is a side view of the container as viewed along the line 4—4 in FIG. 2.
Figure 5:
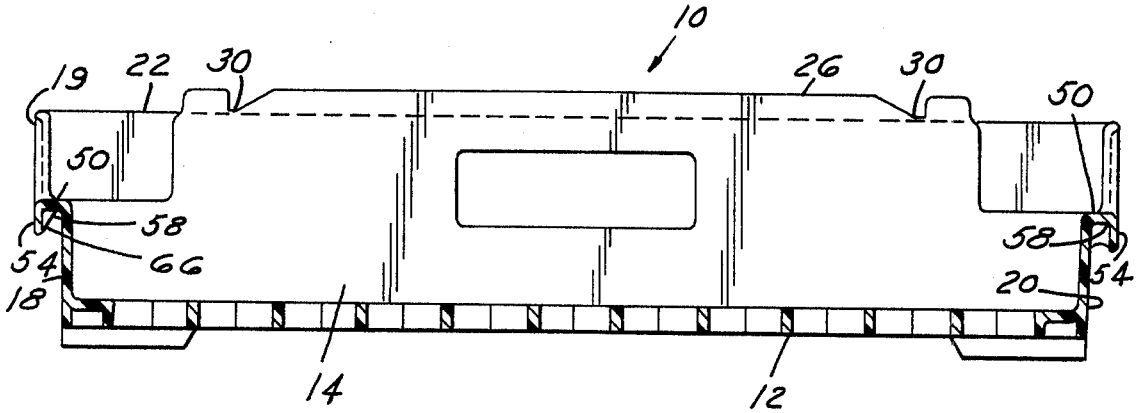
FIG. 5 is a sectional view taken on the line 5—5 in FIG. 2.
Figure 10:
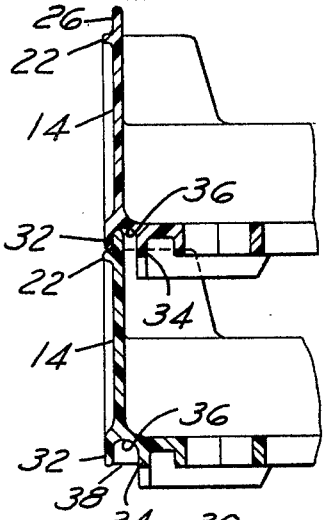
FIG. 10 is a fragmentary sectional view taken on the line 10—10 in FIG. 9.
Figure 9:
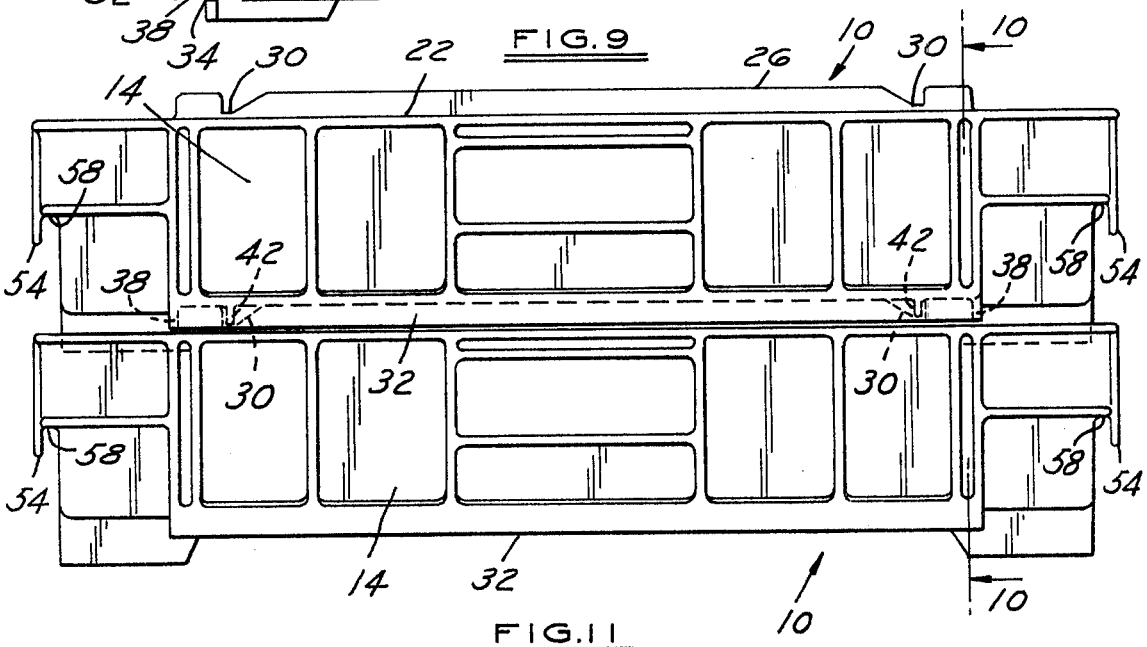
FIG. 9 is a side elevational view showing two containers in stacked relation.
Figure 11:
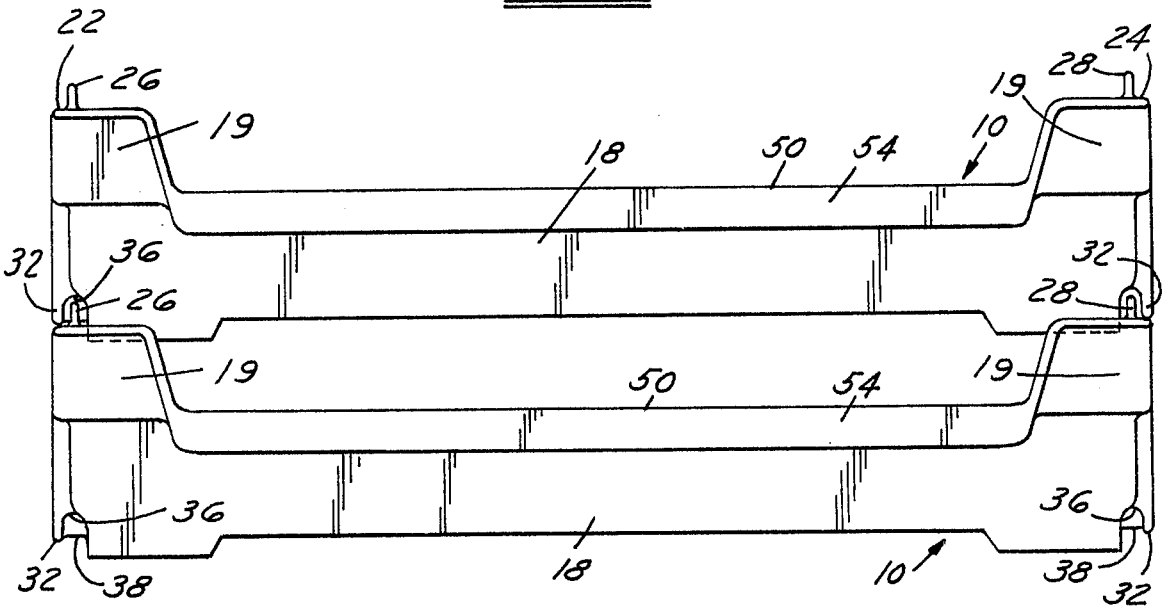
FIG. 11 is a front elevational view showing two containers in stacked relation.
Figure 16:
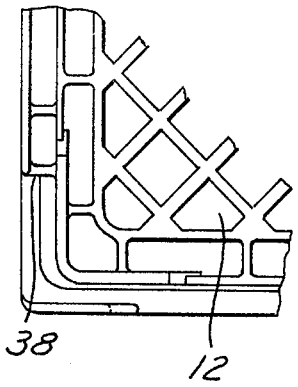
FIG. 16 is a fragmentary sectional view of one corner of the container as seen from the bottom.
Figure 13:
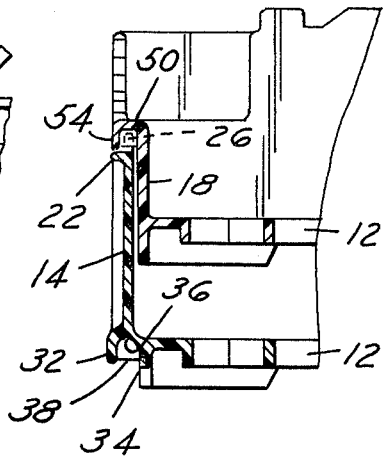
FIG. 13 is a fragmentary sectional view taken on the line 13—13 in FIG. 12.
Figure 15:
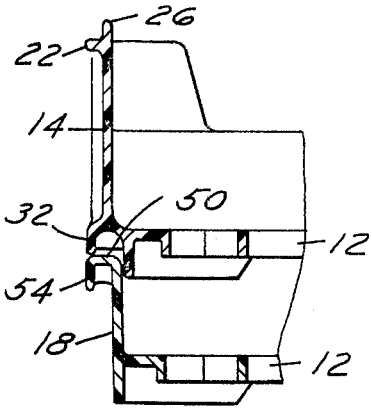
FIG. 15 is a fragmentary sectional view taken on the line 15—15 in FIG. 14.
Figure 12:
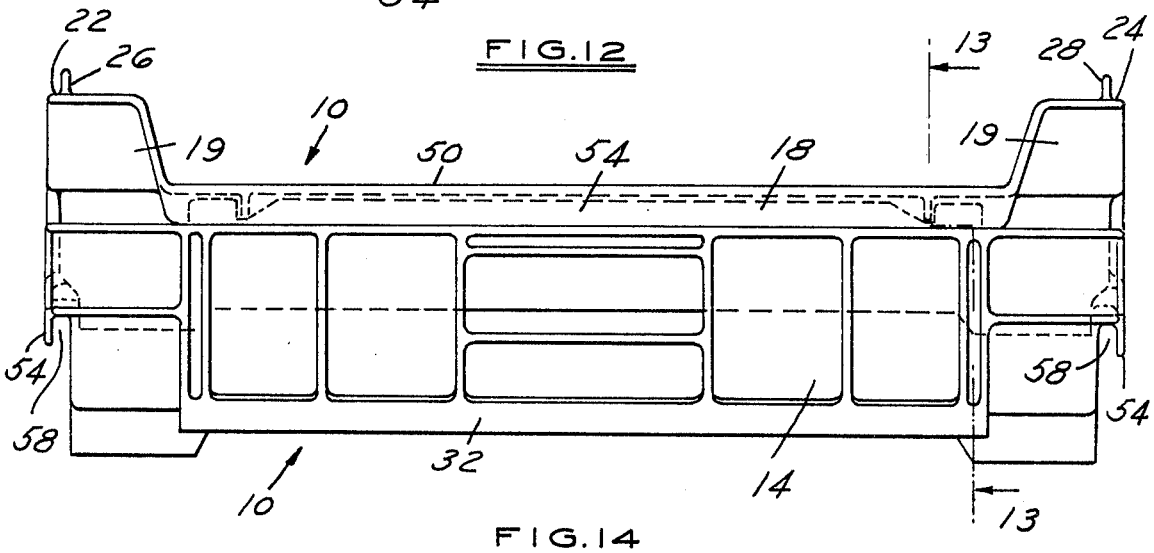
FIG. 12 is a view showing two containers in nested relation as seen from the side of the lower container.
Figure 14:
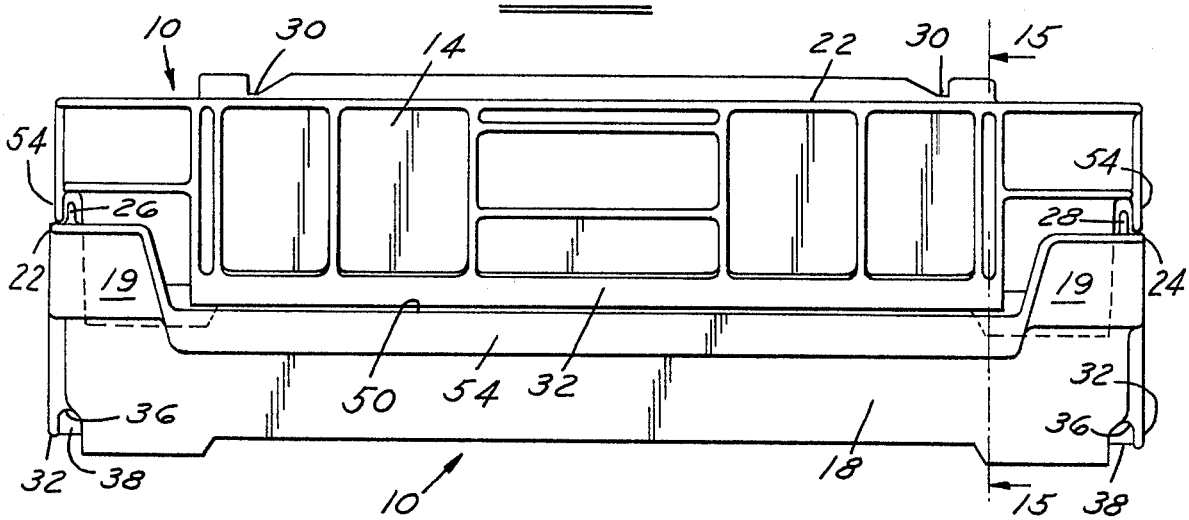
FIG. 14 is a view showing two nested containers as seen from the front of the lower container.

In the nested condition, the front and rear walls of the lower container may be spaced beneath the bottom of the upper container sufficiently to provide clearance (FIGS. 14 and 15). On the other hand, the flanges 32 on the side walls might be extended downwardly farther so that when nested with a lower container they would rest upon the front and rear walls of the lower container to provide support for the upper container on all four sides (FIG. 17).

It is also possible to nest two containers by sliding the upper container across the top of the lower container. This may be done by holding a 90° turned upper container at a slight angle, then sliding it across a lower container with the ends of the grooves 58 in the end walls of the upper container engaged with the rails 26 and 28 on the side walls of the lower container. The grooves may actually run with their webs 68 riding on the rails. When the upper container is directly over the lower container it will drop to nested position.

A stack of nested containers or stacked containers may be continued upwardly within reason to any desired height. When nesting the container may support buns or rolls or any relatively low product. Higher baked goods such as bread and cakes may require stacking instead of nesting.

The end wall portions 19 of the container are desirable to prevent horizontal shifting of an upper nested container in a forward and rearward direction with respect to a lower container. The webs 68 in the grooves 58 of the upper container engage the notches 30 in the stacking rails of the lower container to perform the same function. Such webs and notches might be considered sufficient for the purpose without the end wall portions 19, but in most instances the end wall portions 19 are desired to provide a surer means of preventing horizontal shifting.

It may be noted that the grooves 58 along the end walls do not have the end webs similar to webs 38 that close the ends of the side wall grooves 36. Such end webs could if desired be provided for the end wall grooves to engage the ends of the rails 26 and 28 during nesting and resist relative horizontal shifting, but such additional means to accomplish that function are not considered necessary particularly in view of the presence of the end wall portions 19.

What we claim as our invention is:

1. An upwardly open container having a rectangular bottom wall, side walls extending upwardly from opposite side edges of said bottom wall, said side walls having stacking supports adjacent the upper edge portions thereof, said container having on opposite sides thereof first rests directly under said supports so that said container can be stacked at an upper level with respect to another similarly or reversely oriented container of identical construction by engaging the first rests of the upper container with the stacking supports of the lower container, end walls extending upwardly from the front and rear edges of said bottom wall, said end walls throughout at least a major portion of their length being of less height than said side walls and having second rests disposed below the level of said stacking supports and above the level of said first rests, said second rests being spaced apart the same distance as said stacking supports so that said container can be nested at a lower level with a 90° turned lower container of identical construction by engaging the second rests of the end walls of the upper container with the stacking supports of the side walls of the lower container.

2. The container defined in claim 1, wherein said container when nested with a 90° turned lower container of identical construction has portions thereof engaging and supported by the portions of said end walls of less height, whereby the upper nested container is supported by said lower container on all four sides.

3. The container defined in claim 1, wherein said container when nested with a 90° turned lower container of identical construction has said first rests thereof engaging and supported by said second rests of the lower container, whereby an upper nested container is supported by the lower container on all four sides.

4. The container defined in claim 3, wherein said second rests extend along the upper edge of the portions of said end walls of less height.

5. The container defined in claim 1, wherein said stacking supports comprise elongated parallel rails and said first rests comprise elongated parallel grooves.

6. The container defined in claim 1, wherein said stacking supports comprise elongated parallel rails and said second rests comprise elongated parallel grooves.

7. The container defined in claim 1, wherein said stacking supports comprise elongated parallel rails, said first rests comprise elongated parallel grooves enabling said container to be slid to a stacked position with respect to another similarly or reversely oriented container of identical construction, and said second rests comprise elongated parallel grooves enabling said container to be slid to a nested position with respect to a 90° turned container of identical construction.

8. The container defined in claim 7, wherein said second rests are formed along the upper edge of the portions of said end walls of less height.

9. An upwardly open container having a rectangular nearly square bottom wall, side walls extending upwardly from opposite side edges of said bottom wall, the upper edge portions of said side walls having elongated parallel stacking rails, said container having first rests comprising first elongated parallel grooves in the underside directly under said rails so that said container can be slid to a stacked position at an upper level with respect to another similarly or reversely oriented container of identical construction by engaging the grooves of the upper container with the rails of the lower container, end walls extending upwardly from the front and rear edges of said bottom wall, said end walls having second rests comprising elongated second parallel grooves disposed below the level of said stacking rails and above the level of said first grooves and spaced apart the same distance as said stacking rails so that said container can be nested at a lower level with a 90° turned lower container of identical construction by engaging the second grooves of the upper container with the stacking rails of the lower container, said end walls being so dimensioned as to fit within the side walls of a lower container of identical construction when nested as aforesaid, said end walls throughout at least a major portion of their length being of less height than said side walls and so constructed as to permit an identical upper container to be nested therewith as aforesaid.

10. The container defined in claim 9, wherein the portions of said end walls of less height serve as seating means to support portions of an upper nested container, whereby said upper nested container is supported on all four sides.

11. The container defined in claim 10, wherein said second rests extend along the upper edge of the portions of said end walls of less height to provide said seating means.

12. The container defined in claim 9, wherein the portions of said end walls of less height clear an upper nested container.

* * * * *